US010494778B2

(12) United States Patent
Menzenbach et al.

(10) Patent No.: US 10,494,778 B2
(45) **Date of Patent: *Dec. 3, 2019**

(54) GROUND WORKING MACHINE, AS WELL AS METHOD FOR MILLING GROUND SURFACES OR TRAFFIC SURFACES

(71) Applicant: Wirtgen GmbH, Windhagen (DE)

(72) Inventors: Christoph Menzenbach, Neustadt (DE); Cyrus Barimani, Königswinter (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/865,534

(22) Filed: Jan. 9, 2018

(65) Prior Publication Data

US 2018/0202118 A1 Jul. 19, 2018

Related U.S. Application Data

(63) Continuation of application No. 14/746,990, filed on Jun. 23, 2015, now Pat. No. 9,879,392.

(30) Foreign Application Priority Data

Jul. 23, 2014 (DE) ..... 10 2014 214 436

(51) Int. Cl.
*E01C 23/08* (2006.01)
*E01C 23/12* (2006.01)
(Continued)

(52) U.S. Cl.
CPC ..... *E01C 23/127* (2013.01); *E01C 21/00* (2013.01); *E01C 23/065* (2013.01); *E01C 23/088* (2013.01)

(58) Field of Classification Search
CPC ..... E01C 23/088; E01C 23/127; E01C 23/065
See application file for complete search history.

(56) References Cited

U.S. PATENT DOCUMENTS 4,221,434 A * 9/1980 Swisher, Jr. ..... B28D 1/18 241/101.74
5,893,677 A 4/1999 Haehn et al.
(Continued)

FOREIGN PATENT DOCUMENTS

CN 102465486 A 5/2012
CN 103282583 A 9/2013
(Continued)

OTHER PUBLICATIONS

European Search Report in European Patent Application EP 15 17 6984, dated Nov. 26, 2015, 3 pp. (not prior art).
(Continued)

*Primary Examiner* — Janine M Kreck
(74) *Attorney, Agent, or Firm* — Lucian Wayne Beavers; Patterson Intellectual Property Law, PC

(57) ABSTRACT

In a ground working machine for working ground surfaces or traffic surfaces, in particular cold recycler or soil stabilizer as a self-propelled machine or attachment unit, featuring a machine frame, featuring a milling/mixing drum rotating transversely to the working direction of the machine frame, featuring a drum housing enclosing the milling/mixing drum and resting on the ground surface during the milling operation that forms a mixing chamber for crushing the milled material and/or mixing the milled material with additives, where the milling/mixing drum is height-adjustable for adjustment of a selectable milling depth, featuring a pivotable drum flap arranged, as a minimum, at the front end of the drum housing as seen in working direction, and featuring a controller for, as a minimum, the working process, it is provided for the following features to be achieved: the drum
(Continued)

flap is, as a minimum, of two-part design and comprises no less than one upper part and one lower part, in which design no less than one part is pivotable and no less than one further part is adjustable in a telescoping fashion linearly or in the shape of an arc.

21 Claims, 5 Drawing Sheets

(51) Int. Cl.

| | |
|---|---|
| ***E01C 23/06*** | (2006.01) |
| ***E01C 21/00*** | (2006.01) |
| ***E01C 23/088*** | (2006.01) |

(56) References Cited

U.S. PATENT DOCUMENTS

| | | | | |
|---|---|---|---|---|
| 7,918,512 | B2 * | 4/2011 | Mannebach | E01C 21/00 299/39.4 |
| 7,976,239 | B2 * | 7/2011 | Hall | E01C 23/088 299/39.4 |
| 8,485,755 | B2 * | 7/2013 | Menzenbach | E01C 21/00 299/39.2 |
| 8,511,933 | B2 | 8/2013 | Menzenbach et al. | |
| 8,764,341 | B2 | 7/2014 | Menzenbach et al. | |
| 9,328,467 | B2 | 5/2016 | Forster et al. | |
| 9,879,392 | B2 * | 1/2018 | Menzenbach | E01C 23/127 |
| 2013/0322963 | A1 | 12/2013 | Forster et al. | |
| 2013/0341997 | A1 | 12/2013 | Franzmann et al. | |
| 2015/0091364 | A1 | 4/2015 | Ktting et al. | |

FOREIGN PATENT DOCUMENTS

| | | | |
|---|---|---|---|
| DE | 3843480 | C1 | 10/1989 |
| DE | 102010050831 | A1 | 5/2012 |
| EP | 2025812 | A2 | 2/2009 |
| EP | 2218823 | A2 | 8/2010 |
| EP | 2455544 | A2 | 5/2012 |
| WO | 9624725 | A1 | 8/1996 |
| WO | 2005054578 | A1 | 6/2005 |
| WO | 2012016573 | A1 | 2/2012 |
| WO | 2012062456 | A1 | 5/2012 |

OTHER PUBLICATIONS

Search report dated Feb. 14, 2017 in corresponding China application 201510434911X (not prior art).

* cited by examiner

GROUND WORKING MACHINE, AS WELL AS METHOD FOR MILLING GROUND SURFACES OR TRAFFIC SURFACES

BACKGROUND OF THE INVENTION

1. Field of the Invention

The invention relates to a ground working machine and a method, respectively, for working ground surfaces or traffic surfaces, in particular a cold recycler or soil stabilizer as a self-propelled machine or attachment unit.

2. Description of the Prior Art

Such ground working machines are used for the processing of materials, namely, for example, the stabilization of soils of insufficient load-bearing capacity, the pulverization of asphalt pavements and the recycling of bound or unbound pavement surfaces. For the improvement or stabilization of soils, it is known to introduce a powdered or liquid binding agent into the soil in order to increase the suitability for placing and the load-bearing capacity of said soil. The known ground working machines comprise a milling/mixing drum revolving in a mixing chamber, said milling/mixing drum being arranged, in a height-adjustable fashion, below a drum housing enclosing the milling/mixing drum and attached to the machine frame. The ground working machine may be self-propelled or be an attachment unit. Examples of such machines are described in WO 96/24725 (U.S. Pat. No. 5,893,677), WO 2005/054578 (U.S. Pat. No. 7,918,512) or EP 2218823 A (U.S. Pat. No. 8,511,933).

Reference is made to these earlier patent applications regarding the description of the individual components of such ground working machine.

The required processes, such as crushing of the ground material, addition of binding agents, mixing and spreading of added materials, are performed, in a fashion adapted to the respective application, in the mixing chamber located between the drum housing and milling device.

In a known ground working machine as it is depicted, for example, in FIG. 1, it is already known to provide front and rear pivotable drum flaps at the drum housing in order to limit the escape of the milled-off material or material to be mixed and/or to be crushed, respectively, during the working process. In this design, the position of the drum flaps depends on the task or the nature of the subsoil and the desired work result, respectively. It is thus possible, for example, to influence the grading curve, that is, the size distribution of the milled-off pieces of material, by means of the position of the front drum flap as seen in working direction. In the process, the adjustment of the drum flaps is effected in a pivoting movement about a pivoting axis extending transverse to the working direction and parallel to the axis of the milling/mixing drum.

It is of disadvantage in the mentioned state of the art that, as a result of the layer structure of the ground or traffic surface, the milling/mixing drum can break slabs out of the surface course in particular when operating against the direction of travel in which the milling/mixing drum rotates in opposite direction to the direction of rotation of the wheels or track units.

This is of disadvantage in particular because crushing the existing road pavement according to specification is made more difficult and, in the process, some oversized fragments enter the milled material contained in the mixing chamber so that the size distribution of the milled fragments is inhomogeneous and does not correspond to the specified grain size distribution.

Furthermore, large fragments that are caught by the milling drum can exert unwanted forces on the milling/mixing drum or on the drum housing. In the process, damage may be caused or reactions of the ground working machine generated which rock or lift the machine so that the working process is disturbed and the quality of the work result is impaired.

It is already known from WO 2012/062456 (US 2013/322963) to arrange crusher bars inside the drum housing. The disadvantage is that an additional design effort is required inside the milling drum housing and maintenance of the crusher bar elements is difficult and time-consuming due to the confined space inside the drum housing. In addition, a build-up of the milled material occurs in the mixing chamber so that increased performance is required for the operation of the milling/mixing rotor or the milling process can be performed at a slower operating speed only. Arranging the crusher bar on the inside leads to larger fragments and slabs being hurled against the crusher bar inside the drum housing again and again until they are crushed to such an extent that they can pass through the gap between the milling/mixing rotor and the drum housing. In the process, a build-up of the milled material easily forms which requires the milling/mixing drum to operate with significantly increased resistance.

According to the state of the art, the pivoting angle of the front drum flap is adjustable manually by the machine operator and remains essentially constant for the entire working process. In this arrangement, the drum flap does usually not rest on the ground.

SUMMARY OF THE INVENTION

It is therefore the object of the invention to specify a ground working machine, as well as a method for milling ground surfaces or traffic surfaces in which reproducible crushing of the ground or traffic surface, respectively, can be achieved for different work assignments and in different framework conditions in which it is possible to influence the mean grain size of the fragments and the range of distribution.

The invention advantageously provides for the drum flap to be, as a minimum, of two-part design and to comprise no less than one upper part and one lower part, in which design at least one part is pivotable and at least one further part is adjustable in a telescoping fashion linearly or in the shape of an arc. The extended adjustment possibility of the drum flap enables, by means of the flap position, not only the mean size of the fragments but also the homogeneity of the size distribution to be improved and in particular larger fragments in the milled material to be prevented.

The division of the drum flap in at least two parts, one of which is adjustable in a telescoping manner linearly or in the shape of an arc and another of which is pivotable, enables the drum flap to always be guided, especially at alterable positions of the milling drum inside the drum housing or of the drum housing during the milling process, at an optimal distance from the milling drum for the respective working process and independent of whether the drum flap rests on the ground or not. As a result, an adjustment of the front drum flap has been realized via a pivoting movement combined with a linear or arc-shaped movement.

The drum flap according to the invention allows only material to enter the mixing chamber below the drum housing which has already been sufficiently crushed in front of the drum flap or at the drum flap by the flexible positioning of the same. A build-up inside the drum housing cannot occur so that the milling/mixing drum can operate in the mixing chamber without increased resistance.

The invention is applicable not only to soil stabilizers and cold recyclers but also to further construction machines featuring a milling drum in a milling drum housing, for example, road milling machines, surface miners, in particular if the grading curve of the work result is of importance, wherein the milling drum is height-adjustable via the height adjustment of the frame.

It is preferably provided for the pivoting angle and/or the position of that part of the drum flap being adjustable in a telescoping fashion to be controllable in accordance with the current milling depth in such a fashion that the distance between the drum flap and the milling/mixing drum is variably adjustable, for example, minimized. The distance of the lower part, or of the bottom edge of the lower part, respectively, from the milling/mixing drum is of particular importance. The flexible adjustment of the drum flap enables the grading curve, that is, the mean grain size and the grain size distribution of the milled material to be adjusted reproducibly via the arbitrarily selectable distance between the front drum flap and the milling/mixing drum. The current position of the drum flap, or of the upper and lower parts of the drum flap, respectively, is captured by measurement in order to enable control of the positions.

In a preferred embodiment, it is provided for the pivoting angle of the pivotable part and/or the position of the part of the drum flap being adjustable in a telescoping fashion to be adjustable in accordance with the current milling depth in such a fashion that the bottom edge of the drum flap is usable as a hold-down device.

In this design, the drum flap fulfils, among other things, the following functions as a hold-down device:

- Hold down the uppermost layer of, for example, a road structure
- Prevent slabs from breaking out
- Prevent fragments or slabs from being drawn into the drum casing if these are present nonetheless, and
- Hold the fragments and slabs in their position in front of the milling/mixing drum.

The milling/mixing drum can work off and crush the larger fragments and slabs successively in the held-down position.

It is preferably provided for a controller to control the pivoting angle of the pivotable part of the drum flap and the position of the part adjustable in a telescoping fashion linearly or in the shape of an arc automatically at least in accordance with the current milling depth.

In a further development of the invention, it is intended for a replaceable crusher bar to be arranged at the bottom edge of the lower part. The crusher bar enables a larger distance of the drum flap from the milling/mixing drum to be maintained, in which arrangement the crusher bar prevents larger, uncrushed fragments from being able to enter the mixing chamber.

It may further be intended for multiple, preferably equally spaced, for example, skid-shaped sliding shoes arranged next to one another to be arranged at the bottom edge of the lower part.

The sliding shoes and crusher bar may also be used simultaneously; in particular, sliding shoes may be attached to the lower end of the drum flap, and above the sliding shoes, a crusher bar may project in the direction of the milling/mixing drum.

The sliding shoes, in particular when skid-shaped, can promote the crushing process and, for example, limit the extent of the fragments in transverse direction of the working direction. Material lying in front of the drum housing can enter the drum casing through the free spaces between the skids even when the same is guided over the ground as a hold-down device.

A preferred embodiment provides for the drum flap to be suitable for pressing against the ground or traffic surface at a predetermined contact pressure. The hold-down function of the drum flap can thus be improved. The contact pressure may be applied by means of the own weight or by means of, for example, a hydraulically variably adjustable pressure.

In one embodiment, it may be intended for the upper part to be pivotable and the lower part to be adjustable in a telescoping fashion linearly or in the shape of an arc, in which design the lower part is adaptable, relative to the upper part, to a transverse slope present in the ground or to ground irregularities.

The lower part may be of single-part or multi-part design and may adapt itself to a possibly uneven ground surface or to a milling cut purposely deviating from the horizontal plane.

It may furthermore be intended for the milling/mixing drum to be adjustable in height inside the drum housing along a trajectory and for the controller to control the pivoting position of the pivotable part of the drum flap and/or the position of the part adjustable in a telescoping fashion linearly or in the shape of an arc in accordance with the milling depth and the trajectory of the milling/mixing drum.

It is thus possible to always maintain an optimal distance between the drum flap and the milling/mixing drum irrespective of the position of the milling drum inside the drum housing or the milling depth, respectively. This is of significance in particular if the milling drum inside the drum housing is adjusted in height along a trajectory as not only the position of the milling/mixing drum in vertical direction is altered in the process but also the horizontal distance to the drum flaps, that is, in working direction.

The flexibility of the drum flap provides further advantages:

- Due to the improved movability and controllability of the drum flap, there is furthermore the possibility to optimize already known working procedures, for example, for closing excavation pits in the ground as has been described in EP2455544 (U.S. Pat. No. 8,485,755).
- Following completion of a milling operation, the milling cut can furthermore be profiled (to a specified lateral slope or similar) by means of the flexibly controllable drum flap in reverse travel with the milling/mixing drum being raised.
- The additional use of systems for position determination (e.g. GPS or similar) coupled to the drum flap enables exact positioning of the drum flap for the implementation of construction site-specific requirements.

In a method according to the invention for working ground surfaces or traffic surfaces using a ground working machine, in particular using a cold recycler or soil stabilizer as a self-propelled machine or attachment unit,

- by adjusting the milling depth,
- by milling the ground surface using a height-adjustable milling/mixing drum, and
- by crushing the milled material and/or mixing the milled material with additives in a mixing chamber formed by a drum housing surrounding the milling/mixing drum, where no less than one front pivotable drum flap as seen in working direction forms the boundary of the mixing chamber vis-à-vis the ground, it is provided for a drum flap to be used for variable alteration of the mixing chamber that comprises no less than one pivotable part and one part adjustable in a telescoping fashion linearly or in the shape of an arc.

In the following, embodiments of the invention are explained in more detail with reference to the drawings.

BRIEF DESCRIPTION OF THE DRAWINGS

The following is shown.

DETAILED DESCRIPTION

Figure 1:
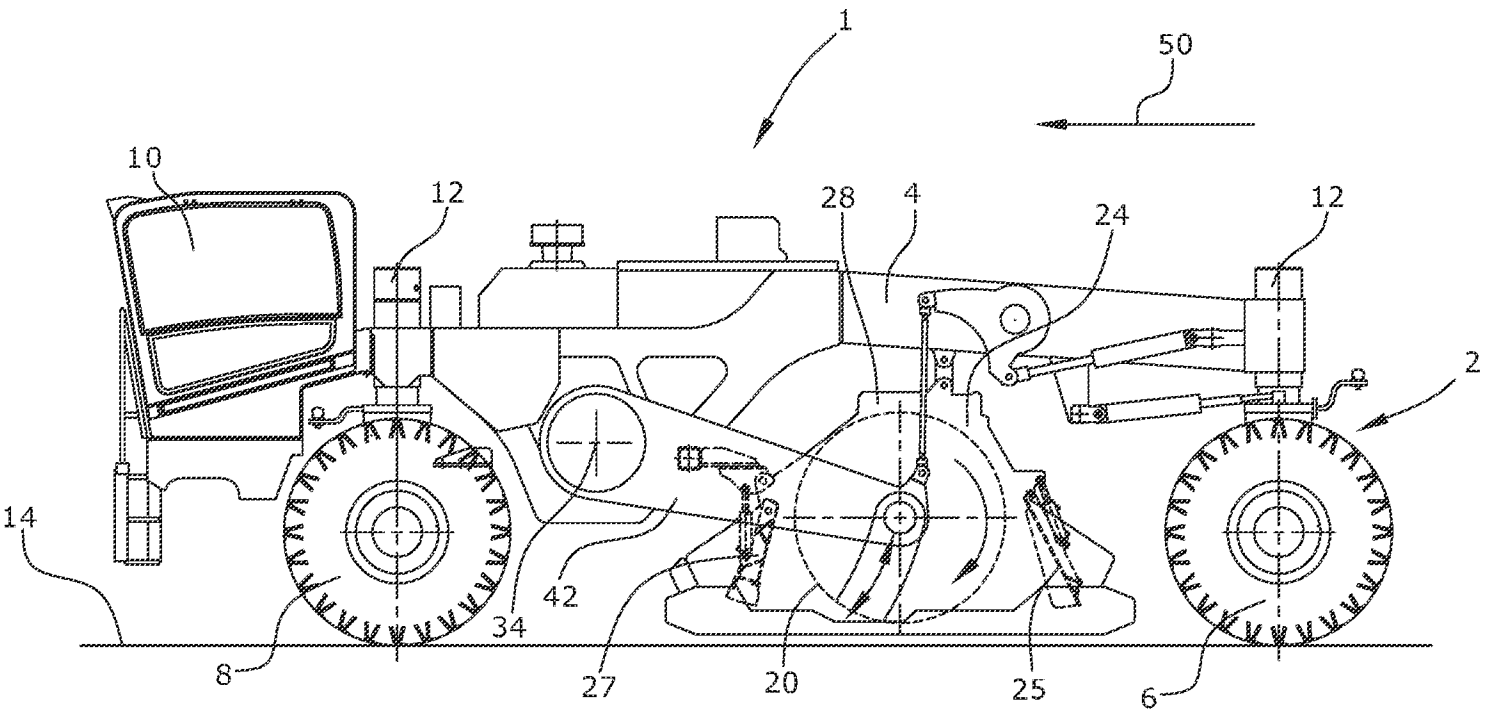
Fig.1 (PRIOR ART)
FIG. 1 a generic ground working machine in accordance with prior art.

FIG. 1 depicts a ground working machine 1, known from WO 2005/054578 (U.S. Pat. No. 7,918,512), for working pavements or stabilizing ground surfaces 14 of insufficient load-bearing capacity or recycling road pavements comprising a surface course 5 and an underlying base course 7, featuring a machine frame 4 supported by a chassis 2. The chassis 2 comprises two each rear and front wheels 6, 8 which are attached to lifting columns 12 in a height-adjustable fashion and which can be raised and lowered independently or synchronously. It is understood that other drive means, such as track chains, may also be intended in lieu of the wheels 6, 8. The lifting columns 12 are attached to the machine frame 4.

Both chassis axles formed by the front and rear wheels 6, 8, respectively, may be steerable.

Figure 2:
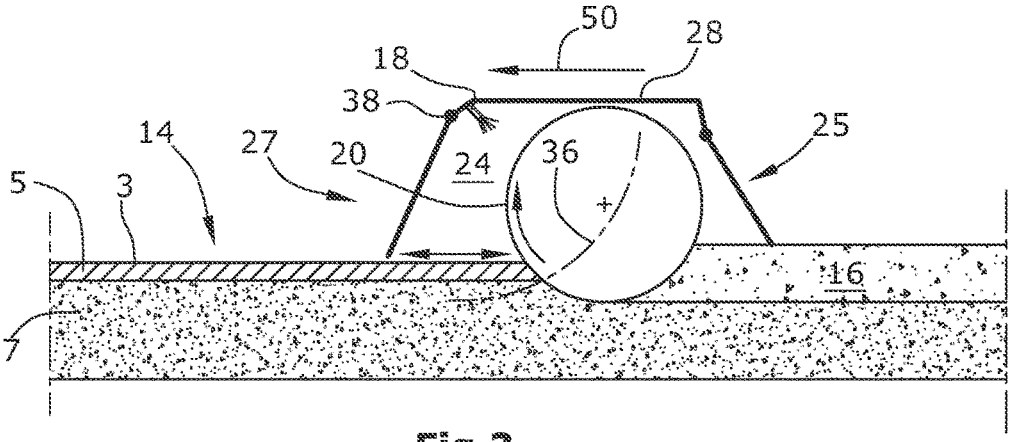
Fig.2 (PRIOR ART)
FIG. 2 the distance of the drum flap from the milling/mixing drum at low milling depth in accordance with prior art, FIG. 3 the distance of the drum flap from the milling/mixing drum at high milling depth in accordance with prior art, FIG. 4 the drum housing according to the invention in operation as a soil stabilizer, FIG. 5 the drum housing according to the invention in cold recycling operation at high milling depth, FIG. 6 an alternative embodiment to the embodiment shown in FIG. 5, FIG. 7 a further embodiment featuring a crusher bar, FIG. 8 a pivoting position of the lower part of the drum flap relative to the upper part, FIG. 9 an embodiment featuring a profiled crusher bar, FIG. 10 a drum flap featuring a divided lower part, and FIG. 11 a drum flap featuring a skid-shaped hold-down device.

As can be inferred from FIGS. 1 and 2, an operator's platform 10 for an operator is arranged at the machine frame 4 above the front wheels 8 or in front of the front wheels 8.

In the embodiment of FIG. 1, the operator's platform 10 is arranged in front of the front wheels 8 or in front of the axles of the front wheels 8, respectively, and can, on no less than one side of the machine, be moved even beyond the outer perimeter of the machine.

The drum housing 28 may be articulated at the machine frame 4 in a fixed manner so that height adjustment of the drum housing 28 can be effected solely by means of the lifting columns 12 for the wheels 6 and 8. The milling/mixing drum 20 preferably rotating against the direction of travel 50, the axis of which extends transverse to the direction of travel, is mounted to pivot about a pivoting axis 34 relative to the machine frame 4 so that it is pivotable from a resting position as depicted in FIG. 1 to a milling position as depicted in the further drawings by means of pivoting arms 42 arranged on both sides. Each pivoting arm 42 is mounted in the machine frame 4 at one end and, at its other end, accommodates the support of the milling/mixing drum 20.

Operation of the ground working machine 1 is also possible in reversing direction, with milling then being performed in the direction of travel.

Figure 9:
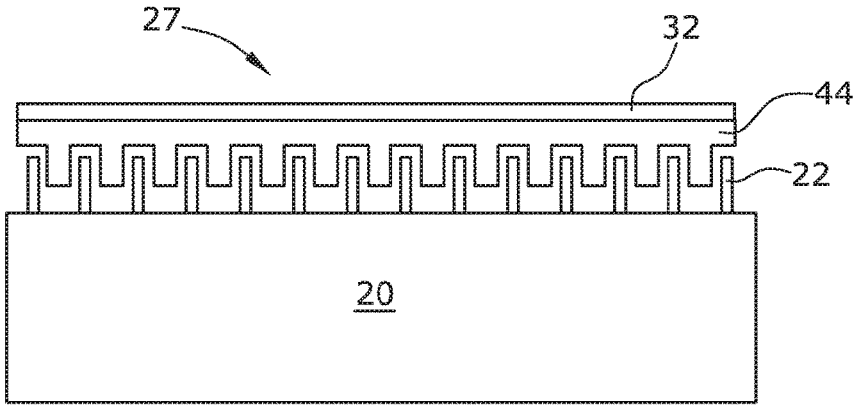

The milling/mixing drum 20 is provided with, for example, milling tools 22 depicted in FIG. 9 in order to be able to work a ground surface or traffic surface 14.

In operating position, the drum housing 28 rests on the ground surface 3 of the ground 14 to be worked or is held at a small distance to the ground 14 while the milling/mixing drum 20 is pivotable further downwards in accordance with the predetermined milling depth. In this arrangement, a lateral boundary of the drum housing may be formed by movable side plates. A mixing chamber 24 with a variable mixing chamber volume depending on the milling depth is thus formed between the drum housing 28 and the milling/mixing drum 20. The mixing chamber volume may also be influenced by additional internal adjustable flaps in the drum housing that are generally known from DE 10 2010 050 831 (US 2013/322963). In the mixing chamber 24, additives can be introduced via, for example, a spraying device 18 and mixed with the milled material. The milling/mixing drum 20 comprises pivotable drum flaps 27, 25 at its front and rear edges. According to the prior art, the front drum flap 27 as seen in the direction of travel 50 is slightly raised during operation so that it does not rest on the ground, and the rear drum flap 25 as seen in the direction of travel 50 can be used as a scraper blade.

The maximum amount of lowering a drum housing 28 attached to the machine frame 4 in a non-fixed manner may be determined by a limiting device.

It is thus intended for such drum housing 28 to rest on the ground surface 14 in a floating fashion. As already mentioned, however, the drum housing 28 is preferably attached to the machine frame 4 in a fixed manner.

Figure 3:
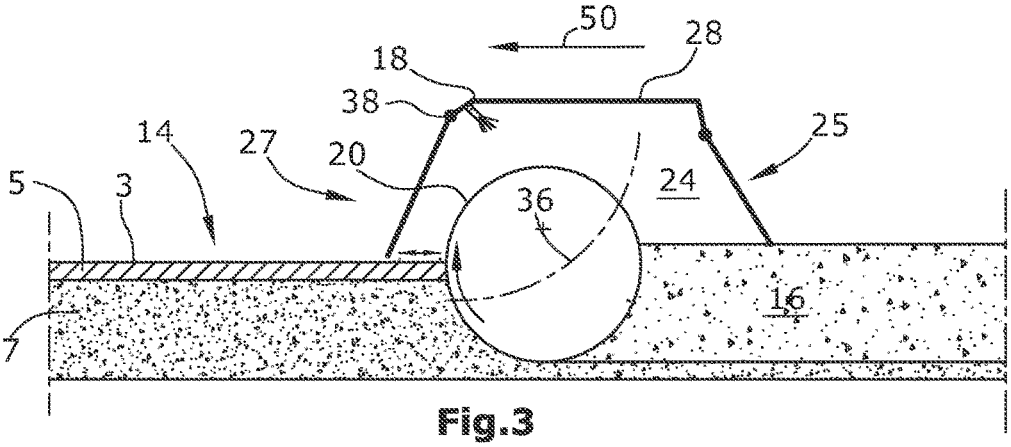
Fig.3 (PRIOR ART)

FIGS. 2 and 3 each show a conventional solution comprising a front pivotable drum flap 27 which is pivotable, at the drum housing 28, about a pivoting axis 38 extending parallel to the milling/mixing drum 20. FIG. 2 shows the position of the milling/mixing drum 20 in the mixing chamber 24 at a low milling depth, and FIG. 3 shows the position at a high milling depth. The different positioning is a result of the milling/mixing drum 20 being moved below the drum housing 28 along a trajectory 36 that is determined by the pivoting movement of the pivoting arms 42 about the pivoting axis 34. It can clearly be seen that the distance A between the lower end of the drum flap 27 and the milling/mixing drum 20 differs greatly so that, in case of a low milling depth, large slabs and fragments of the surface course 5 can break out when milling against the direction of travel. The slabs and large fragments caught by the milling/mixing drum 20 can exert unwanted forces on the milling/mixing drum 20 or on the drum housing 28. In the process, increased wear and tear may be caused or reactions of the ground working machine generated which rock or lift the machine so that the working process is disturbed and the quality of the work result is impaired. In addition, there is the disadvantage of the crushing homogeneity of the milled material 16 being greatly impaired because of the large fragments forming on account of the slabs breaking out.

The problem occurs both at a large milling depth and is significantly compounded in case of a low milling depth.

Even if the milling drum is not moved along a trajectory 36 but merely up and down vertically inside or together with the drum housing 28, there is the problem of the different distances of the drum flap 27 to the milling/mixing drum 20 and the resulting inhomogeneous size distribution of the milled-off fragments due to the circular geometry of the milling/mixing drum 20.

Figure 4:
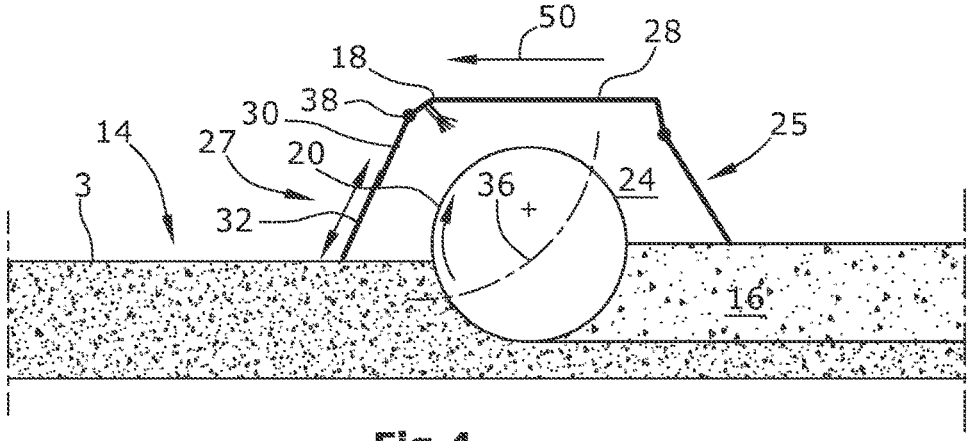

FIG. 4 shows a first embodiment according to the invention in which the drum flap 27 takes a position suitable for soil stabilization.

The drum flap 27 is, as a minimum, of two-part design and in FIG. 4 features a pivotable upper part 30 which is pivotable about the pivoting axis 38, and a lower part 32 movable linearly along the upper part 30.

It is understood that the upper part 30 and the lower part 32 need not necessarily be rectilinear but may also feature a cross-sectional shape adapted to the diameter of the milling/mixing drum 20.

It is of the essence that the front drum flap 27, with its bottom edge or with its relative position to the milling/mixing drum 20, respectively, can be positioned differently in accordance with the milling depth or the position of the milling drum axis along the trajectory 36, respectively.

Figure 5:
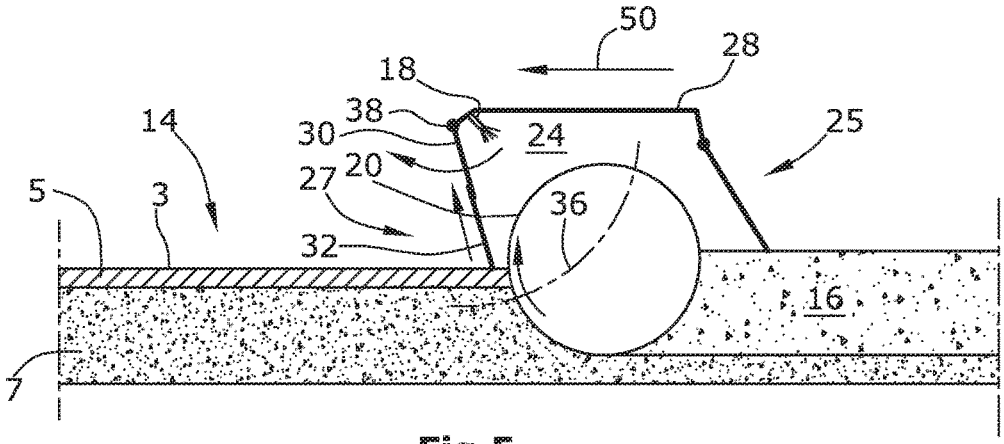

FIG. 5 shows the flap position of the front drum flap 27 in case of a cold recycling process performed at high milling depth. With its bottom edge, the drum flap 27 is brought very close to the milling/mixing drum 20, with the bottom edge of the lower part 32 simultaneously resting on the surface course 5. The bottom edge of the lower part 32 can thus be simultaneously used as a hold-down device, which additionally reduces the risk of slab formation.

Figure 6:
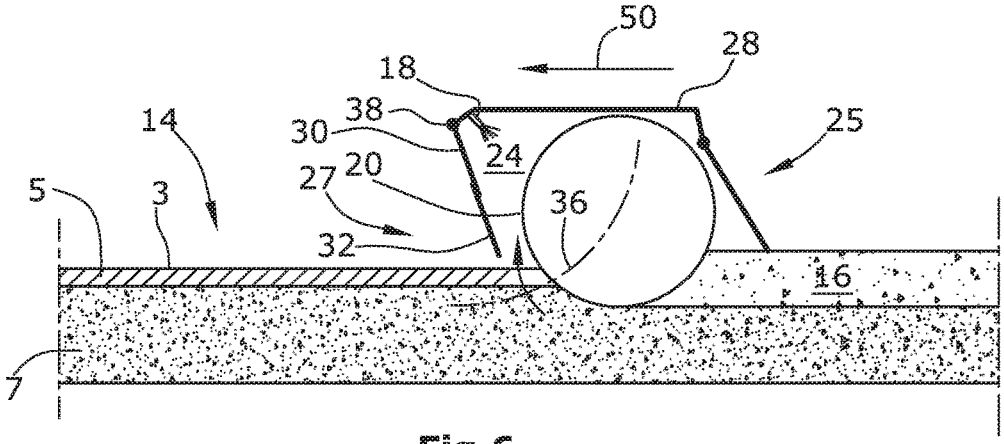

FIG. 6 shows an alternative embodiment in a cold recycling process at, for example, a low milling depth in which the bottom edge of the lower part 32 maintains a distance to the ground surface 3 but where the distance to the milling/mixing drum 20 is simultaneously minimized. In this case, the intrusion of larger fragments is safely excluded by the small distance between the drum flap 27 and the milling/mixing drum 20 so that the size distribution of the fragments in the mixing chamber 24 is homogenized to the greatest possible extent.

It is safely excluded by means of the embodiments shown in FIGS. 5 and 6 that larger fragments or slabs, respectively, can enter the mixing chamber 24 and can possibly damage the milling/mixing drum 20 or the drum housing 28 or impair the milling process.

Figure 7:
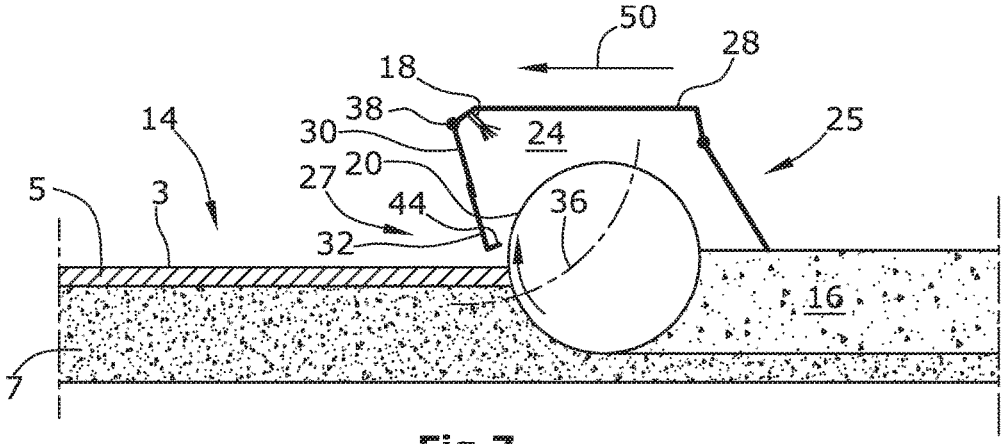

FIG. 7 shows an alternative embodiment in which a crusher bar 44 is additionally arranged at the bottom edge of the lower part 32, said crusher bar 44 projecting from the bottom edge of the lower part 32 in the direction of the milling/mixing drum 20. In this case, it can also be reliably prevented that larger fragments, which can form in particular when milling against the direction of travel, can enter the mixing chamber 24. If larger fragments are formed, these are prevented by the crusher bar 44 from entering the milling/mixing chamber so that the milling/mixing drum 20 can gradually work these off prior to them being able to enter the mixing chamber 24 in crushed condition. Fragments of the milled material colliding with the bar from below break into pieces at the crusher bar 44 so that said crusher bar 44 also contributes to the crushing process.

Replaceable crusher bars 44 at the lower end of the drum flap 27 offer the advantage that they can be replaced quickly and easily with the wear protection of the drum flap 27 and the drum housing 28 being improved.

Figure 8:
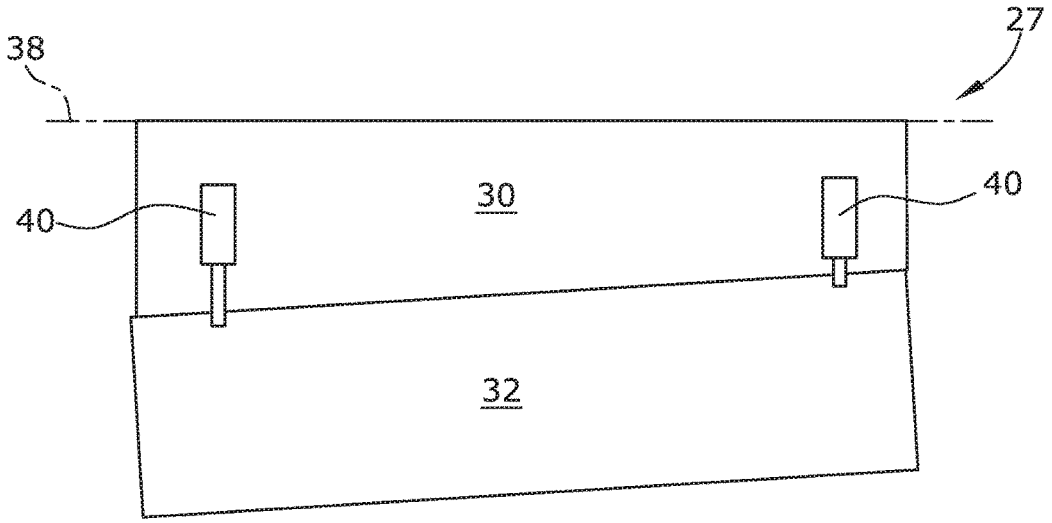

FIG. 8 shows an embodiment in which the lower part 32 can be pivoted relative to the upper part 30 in order to be able to adapt to current or permanent ground irregularities.

In addition, the pivotable lower part 32 is usable also in those cases in which the milling cut is intended to purposefully extend obliquely in comparison with the existing ground surface or traffic surface 14, for example, deviating from the horizontal plane.

The position of the lower part 32 relative to the upper part 30 can be adjusted by means of piston-cylinder units 40. The piston-cylinder units 40 can perform both the pivoting movement of the lower part 32 relative to the upper part 30 and the telescoping, linear/arc-shaped adjustment.

The piston-cylinder units 40 can also be used to press the lower part 32 against the ground surface or traffic surface 14 exerting a predetermined contact pressure.

FIG. 9 shows a crusher bar 44 projecting in the direction of the milling/mixing drum 20, said crusher bar 44 projecting from the lower part 32 and comprising a toothed outer contour. The outer contour is adapted to the line spacing of the tools 22 of the milling/mixing drum 20. The crusher bar 44 is adjustable in a flexible fashion owing to the controllable drum flap 27 so that the engagement of the crusher bar 44 in the gaps between the tools 22 is adjustable in order to also influence the grading curve in this way. The crusher bar 44 may also feature other and especially simpler forms, as shown in FIG. 7, and need not feature the toothed outer contour inferable from FIG. 9.

Figure 10:
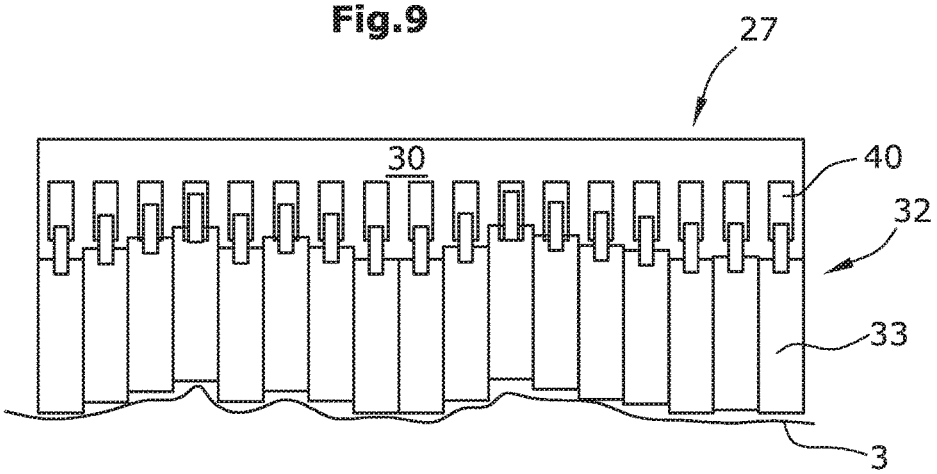

FIG. 10 shows a further embodiment of the lower part which is divided in multiple partial elements 33. This enables an extremely high degree of flexibility for adaptation to the contour of the ground surface 3. Each partial element 33 is coupled to the upper part 30 of the drum flap 27 by means of a piston-cylinder unit 40 so that each partial element 33 can be adjusted individually.

Figure 11:
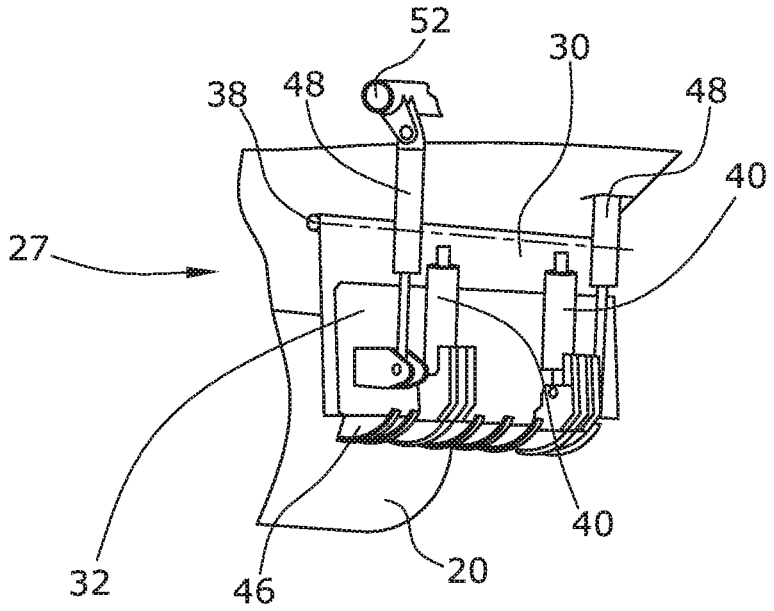

FIG. 11 shows piston-cylinder units 48 which are attached to the drum flap 27 on the one hand and to an attachment 52 of the machine frame 4 on the other. The drum flap 27 can be pivoted by means of the piston-cylinder units 48 while the lower part 32 can be adjusted relative to the upper part 30 by means of the piston-cylinder units 40.

It is understood that the lower ends of the piston-cylinder unit 48 may also be attached to the upper part 30 in lieu of the lower part 32, as shown in FIG. 11.

FIG. 11 furthermore shows an embodiment in which skid-type sliding shoes 46 are attached to the bottom side of the lower part 32. These can also be pressed against the ground surface 3 or a traffic surface. Material lying in front of the drum housing 27 can enter the drum housing 27 through the free spaces between the sliding shoes 46 even if said sliding shoe 46 is guided over the ground surface 3 as a hold-down device.

The invention claimed is:

1. A ground working machine, comprising:

a machine frame having a working direction;

a plurality of wheels or tracks for supporting the machine frame from a ground surface;

a working drum supported from the machine frame to rotate about a rotational axis transverse to the working direction of the machine frame, the working drum configured to rotate in an opposite direction to a direction of rotation of the wheels or tracks during forward milling operation in the working direction, the working drum being height adjustable to adjust a milling depth; and a drum housing enclosing the working drum and forming a mixing chamber, the drum housing including a front drum flap with reference to the working direction, the drum flap including:

at least one upper flap part and at least one lower flap part, both the upper and lower flap parts closing the drum housing from the front;

wherein at least one of the upper and lower flap parts is pivotable so as to have an adjustable pivoting angle; and wherein at least one of the upper and lower flap parts has an adjustable telescoping position.

2. The ground working machine of claim 1, wherein:

at least one of the pivoting angle and the telescoping position is adjustable to thereby adjust a distance between the drum flap and the working drum.

3. The ground working machine of claim 2, wherein:

the at least one of the pivoting angle and the telescoping position is adjustable such that a bottom edge of the drum flap provides a hold-down device.

4. The ground working machine of claim 1, further comprising:

a replaceable crusher bar arranged adjacent a bottom edge of the at least one lower flap part.

5. The ground working machine of claim 1, further comprising:

a plurality of skid shaped sliding shoes arranged next to one another adjacent a bottom edge of the at least one lower flap part.

6. The ground working machine of claim 5, wherein:

the sliding shoes are equally spaced apart from each other.

7. The ground working machine of claim 1, wherein:

the drum flap is configured to press against a ground surface at a predetermined contact pressure.

8. The ground working machine of claim 1, wherein:

the at least one lower flap part has an adjustable transverse slope.

9. The ground working machine of claim 1, wherein:

the at least one lower flap part is configured to be conformable to irregularities in the ground surface.

10. The ground working machine of claim 1, wherein:

the adjustable telescoping position is adjustable linearly.

11. The ground working machine of claim 1, wherein:

the adjustable telescoping position is adjustable in a shape of an arc.

12. The ground working machine of claim 1, wherein:

the at least one upper flap part is pivotably connected to the drum housing and has the adjustable pivoting angle; and the at least one lower flap part has the adjustable telescoping position relative to the upper flap part.

13. A method of working a ground surface or a traffic surface with a ground working machine supported from the ground surface by wheels or tracks, comprising:

(a) milling the ground surface or traffic surface in a working direction using a height adjustable milling drum, the milling drum rotating in an opposite direction to a direction of rotation of the wheels or tracks;

(b) mixing milled material in a mixing chamber formed by a drum housing surrounding the milling drum, the drum housing including at least a front pivotable drum flap including at least one pivotable flap part and one telescoping flap part;

(c) adjusting a milling depth of the milling drum; and (d) altering the mixing chamber by adjusting at least one of a pivoting angle of the pivotable flap part and a telescoping position of the telescoping flap.

14. The method of claim 13, wherein:

step (d) further comprises adjusting a ground-parallel distance between the front pivotable drum flap and the milling drum.

15. The method of claim 13, wherein:

step (d) further comprises holding down the ground surface or traffic surface with a bottom edge of the front pivotable drum flap to reduce formation of large slabs of milled off material.

16. The method of claim 13, further comprising:

pressing a bottom edge of the front pivotable drum flap against the ground surface or the traffic surface at a predetermined contact pressure.

17. A ground working machine, comprising:

a plurality of wheels or tracks for supporting the ground working machine from a ground surface;

a rotatable milling drum, the milling drum configured to rotate in an opposite direction to a direction of rotation of the wheels or tracks during forward milling operation in a working direction, the milling drum being adjustable in height relative to the ground surface to adjust a milling depth;

a drum housing defining a housing chamber, the milling drum being received in the housing chamber, the drum housing including a pivotable front flap closing the drum housing from the front relative to the working direction of the working machine, the front flap including a telescoping flap part;

a first actuator configured to adjust a pivot angle of the front flap; and a second actuator configured to adjust a telescoping position of the telescoping flap part.

18. The ground working machine of claim 17, wherein:

the milling drum is mounted on a pair of pivotable swing arms such that the milling drum moves along an arcuate trajectory relative to a machine frame to adjust the milling depth.

19. The ground working machine of claim 17, further comprising:

a crusher bar attached to the flap and extending into the housing chamber.

20. The ground working machine of claim 17, further comprising:

a plurality of sliding shoes attached to the flap.

21. The ground working machine of claim 17, wherein:

the flap has an adjustable transverse slope.

* * * * *